US006789495B2

(12) United States Patent
Brower et al.

(10) Patent No.: US 6,789,495 B2
(45) Date of Patent: Sep. 14, 2004

(54) SELF-SUPPORTING BOAT COVER

(75) Inventors: Richard M. Brower, Johnstown, NY (US); Jason Pajonk-Taylor, Ballston Spa, NY (US)

(73) Assignee: Nelson A. Taylor Co., Inc., Gloversville, NY (US)

( * ) Notice: Subject to any disclaimer, the term of this patent is extended or adjusted under 35 U.S.C. 154(b) by 74 days.

(21) Appl. No.: 10/178,737

(22) Filed: Jun. 25, 2002

(65) Prior Publication Data

US 2003/0234036 A1 Dec. 25, 2003

(51) Int. Cl.[7] ..... B63B 17/00; E04H 15/06

(52) U.S. Cl. ..... 114/361; 135/88.01; 135/125; 52/3; 150/166

(58) Field of Search ..... 114/361; 135/87, 135/88.01, 125, 136, 138; 52/3; 150/154, 166; 296/102, 104, 105

(56) References Cited

U.S. PATENT DOCUMENTS 2,493,833 A 1/1950 Reynolds
2,797,697 A * 7/1957 Gilmore et al.
2,864,391 A 12/1958 Stark
3,042,053 A * 7/1962 Gabreil
3,313,012 A * 4/1967 Thier
3,354,892 A 11/1967 Frieder
3,896,832 A 7/1975 Montoya
4,075,723 A 2/1978 Bareis et al.
4,184,501 A * 1/1980 Johnson
5,228,408 A 7/1993 Jannausch
5,479,872 A * 1/1996 Hulett
5,494,329 A * 2/1996 Gonzalez et al.
5,690,133 A * 11/1997 Capwell
5,927,311 A * 7/1999 Jager
6,129,034 A 10/2000 Santa Cruz et al.
6,227,557 B1 * 5/2001 Perret

* cited by examiner

*Primary Examiner*—Robert Canfield
(74) *Attorney, Agent, or Firm*—Nixon & Vanderhye P.C.

(57) ABSTRACT

A self-supporting boat cover includes a cover member having a plurality of sleeves that extends substantially longitudinally from a bow end of the cover member to a stern end. A corresponding plurality of flexible poles are insertable in the sleeves through either end of the sleeves and are releasably securable in the sleeves. The self-supporting boat cover is easily installed and inexpensive to manufacture. Additionally, the flexible poles can be readily disassembled into a plurality of pole sections into a compact and easily transportable configuration.

19 Claims, 4 Drawing Sheets

SELF-SUPPORTING BOAT COVER

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a boat cover and, more particularly, to a self-supporting boat cover including shock-corded poles that support the cover and aid in the run-off of rainwater.

Boat covers are typically employed to protect a boat from environmental elements and the like. In order to prevent rainwater and other debris from collecting on a surface of an installed boat cover, it is desirable to construct the boat cover so that its top surface is convex, allowing rainwater, debris and the like to run off the boat cover and away from the boat. Previous constructions that have been designed for this purpose are generally complicated, difficult to install and expensive to manufacture. Additionally, conventional constructions typically are separate from the cover itself and not integrated into the cover, do not stay in place very well, when they fall or move from intended position, their effectiveness diminishes, and they most often are purchased separately, thereby adding cost beyond the initial purchase. Moreover, the effective range of these products is typically quite limited, i.e., a support pole in the stern will not allow water run-off in the bow area. These products create "points" of stress on the fabric cover—not distributed over the entire cover. Many of the other types of supporting devices require modification of the boat, including drilling holes, adding permanently mounted hardware, etc.

BRIEF SUMMARY OF THE INVENTION

The present invention, in contrast with conventional arrangements, is highly effective while being simple to install and inexpensive to manufacture. In an exemplary embodiment of the invention, a self-supporting boat cover includes a cover member having a plurality of sleeves that extend substantially longitudinally from a bow end of the cover member to a stern end. A corresponding plurality of flexible poles are insertable in the sleeves through either end of the sleeves, wherein the flexible poles are releasably securable in the sleeves. The sleeves may be arranged to converge from one of the bow end and the stern end toward the other of the bow end and the stern end. Each end of the sleeves may include an open portion and a closed portion defining an entry channel and a holding area for the flexible poles, respectively. The sleeves extend along at least 70%, and preferably at least 80%, of the cover member, wherein the flexible poles are configured in a length slightly shorter than a length of the sleeves.

Each of the flexible poles may include a plurality of pole sections releasably secured to one another, the number of pole sections being dependent on a length of the cover member. In this context, each of the pole sections may include a first end containing an insert tube disposed partially in and partially out of the pole section and a second end sized to receive the insert tube of an adjacent pole section. An elastic cord is internally secured between each of adjacent pole sections, which elastic cord biases the adjacent pole sections toward engagement with each other. Each of the flexible poles includes at least five pole sections, preferably ten pole sections.

In another exemplary embodiment of the invention, a method of securing the self-supporting boat cover of the invention to a boat is provided. The method includes the steps of (a) attaching the cover member to the boat; and (b) releasably securing the flexible poles into respective ones of the sleeves. In this context, step (b) may be practiced by inserting the flexible poles through the entry channel then securing the flexible poles in the holding area. Prior to step (b), the flexible poles may be assembled by releasably securing a plurality of pole sections to one another, the number of pole sections being dependent on a length of the cover member.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
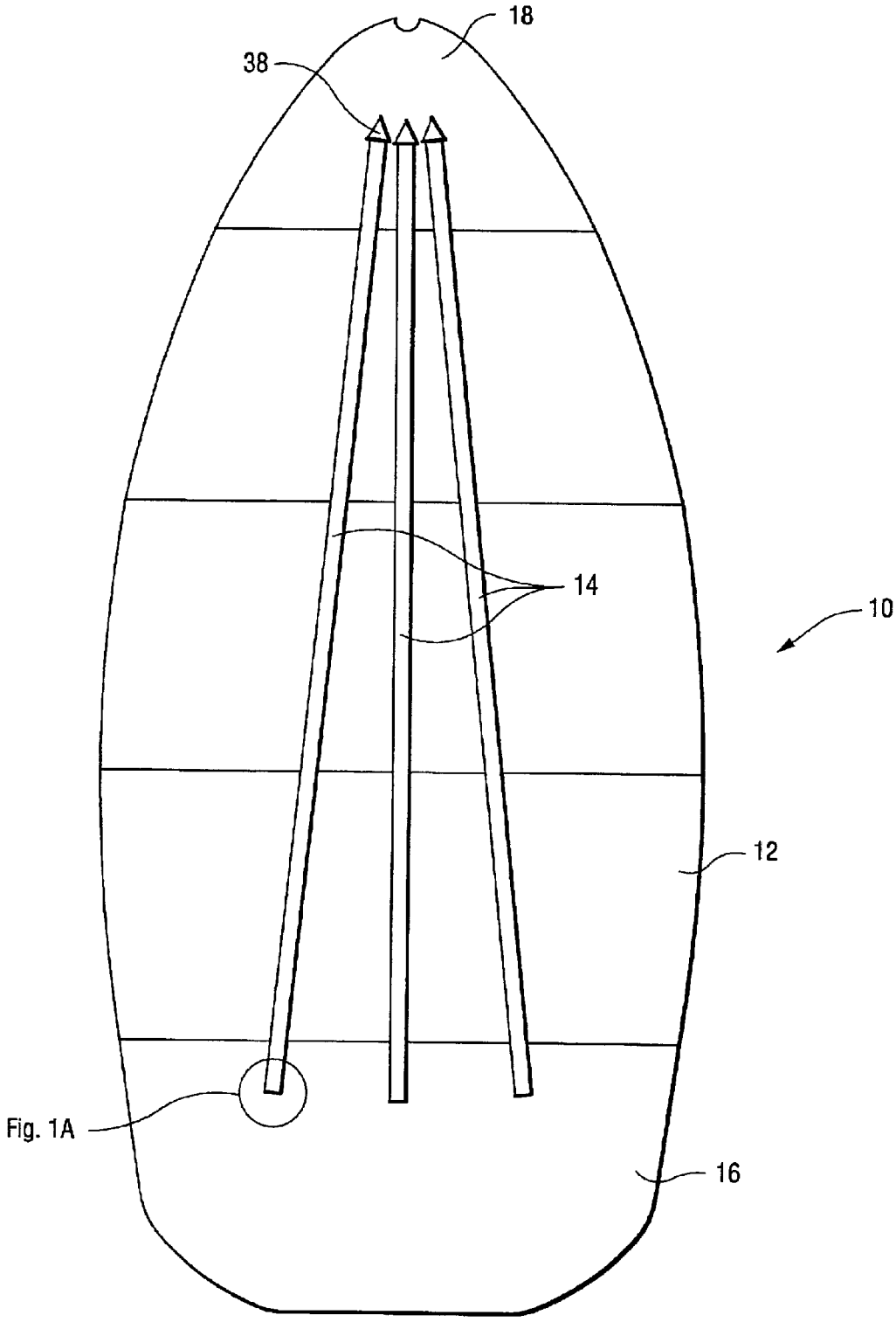
FIG. 1 is a plan view showing the self-supporting boat cover according to the present invention.

With reference to FIG. 1, the self-supporting boat cover 10 according to the present invention is generally sized and shaped according to a size and hull style of various boats. Generally, the cover 10 includes a cover member 12 formed of a fabric material such as a coated synthetic or the like. A plurality of reinforced fabric tubes or sleeves 14 are secured to the cover member 12, preferably by sewing. As shown in FIG. 1, the sleeves 14 are arranged in a converging pattern, preferably converging from a stern end 16 toward a bow end 18 of the fabric cover member 12. The sleeves 14 extend along at least 70% of the cover member 12, preferably at least 80% of the cover member.

Figure 2:
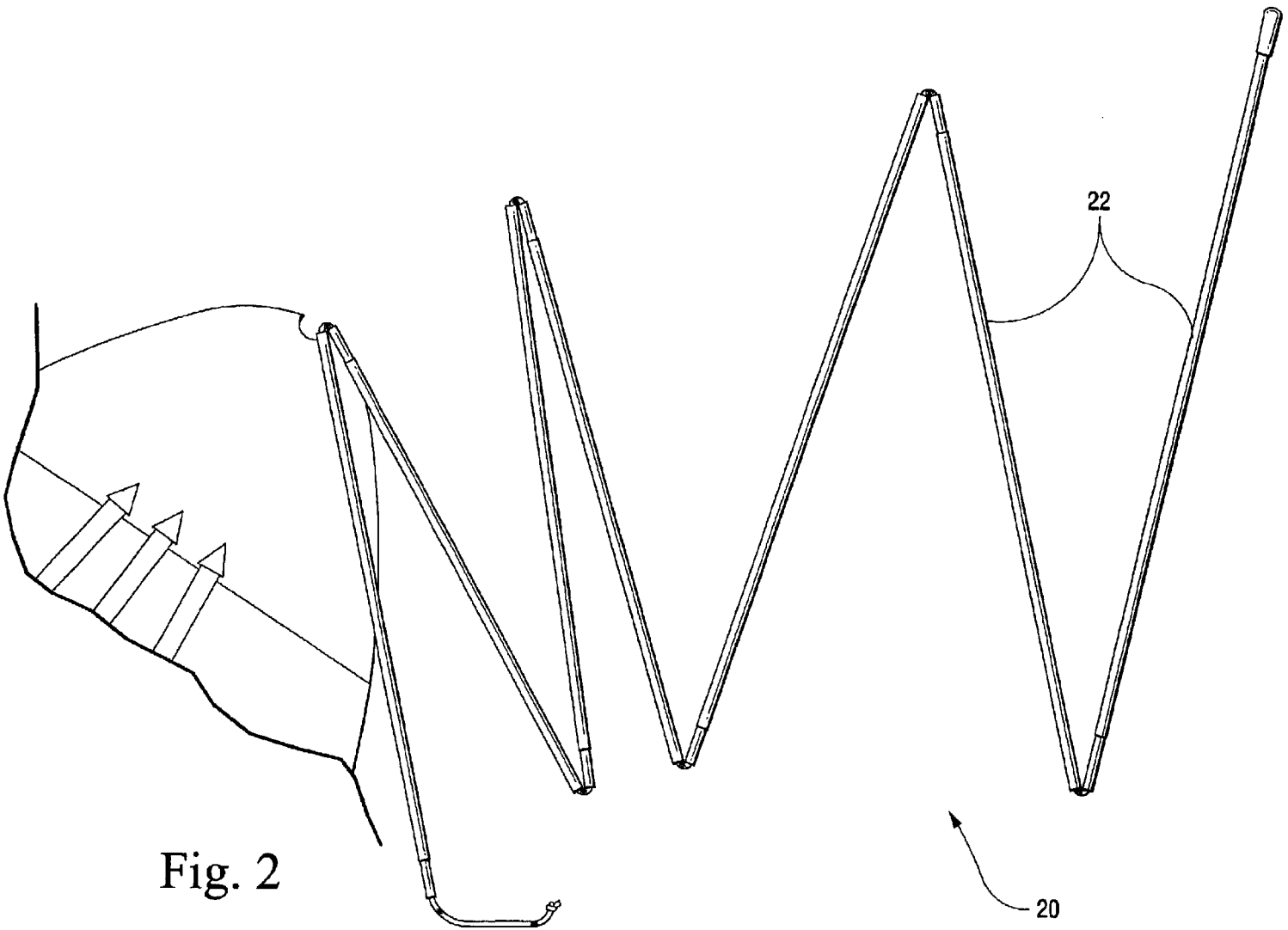
FIG. 2 shows one of the shock-corded poles in an unassembled configuration.
Figure 3:
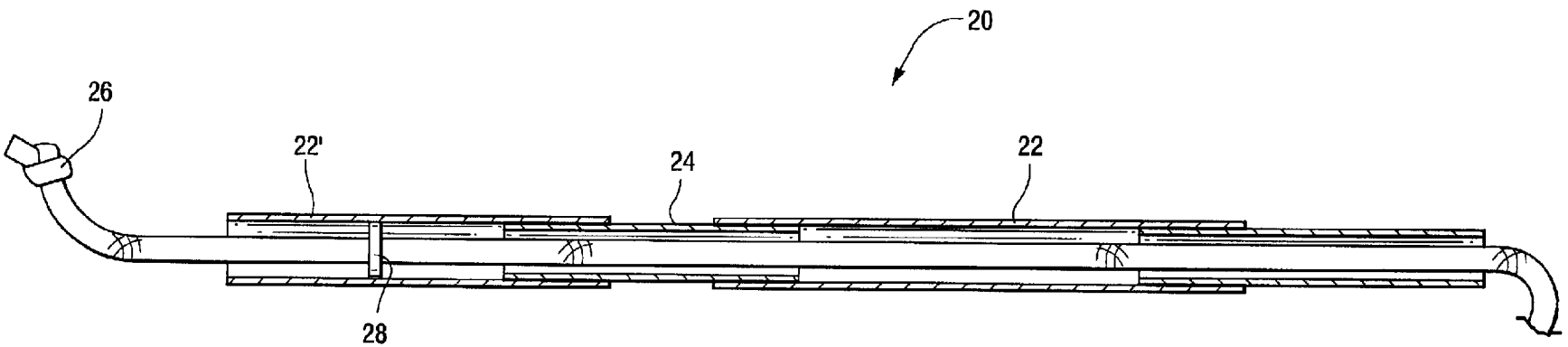
FIG. 3 is a cross-sectional view showing the construction of the shock-corded poles.

The sleeves 14 each receive a shock-corded pole 20 as shown in FIGS. 2 and 3. Each of the shock-corded poles 20 includes a plurality of pole sections 22 that are releasably secured to one another. Unassembled, the pole sections 22 enable the shock-corded poles 20 to be "folded" into a compact configuration. The number of pole sections 22 for each pole 20 is generally dependent upon a length of the cover member 12 and storage considerations. Generally, each pole 20 includes at least five pole sections 22 and preferably at least ten pole sections 22.

The converging sleeve/pole arrangement provides support to the cover member 12 in an even, design specific manner. A critical area (as far as the distribution of support) is that between the windshield and the very back of the stern. If the poles 20 are too far apart, the cover member 12 may pocket water in the spaces between them; if they are too close together, the cover member 12 may pocket water at the sides. The bow area is much more forgiving; the area from the windshield forward is typically smaller in distance and most always tapered towards the bow. Therefore, the bow is preferably the beginning point for the pole ends to be the closest together. Also, the relative length of the poles/sleeves is generally design specific; for instance, this product line will be a limited number of SKU's; the same cover/pole will fit (and function) on similar hull-style boats from 17' to 19'. The poles provide the proper support area on the 19' model, i.e., not allowing the cover member 12 to pocket water at the end of the poles/sleeves (in front of the stern), while not being too long for the stern area on the 17' boat.

With reference to FIG. 3, an end pole section 22' and an adjacent pole section 22 of a shock-corded pole 20 is shown. An insert tube 24 is fixed at one end of the pole sections 22 in a partially in and partially out configuration via an adhesive or other suitable means. An end of an adjacent pole section is sized to receive the part of the insert tube 24 that is disposed out of the supporting pole section 22. An elastic cord 26 is internally secured at least in the end pole sections 22' via a flat washer 28 or the like and a knot in the elastic cord 26. The elastic cord 26 serves to bias the adjacent pole sections 22 toward engagement with each other. When assembled, each of the poles 20 is readily flexible while being securely assembled and easily and compactly disassembled. A flexible vinyl end cap may be secured at each end of the assembled poles 20, keeping the pole ends from tearing the sleeves 14 and protecting the consumer when installing the poles 20.

Figure 1A:
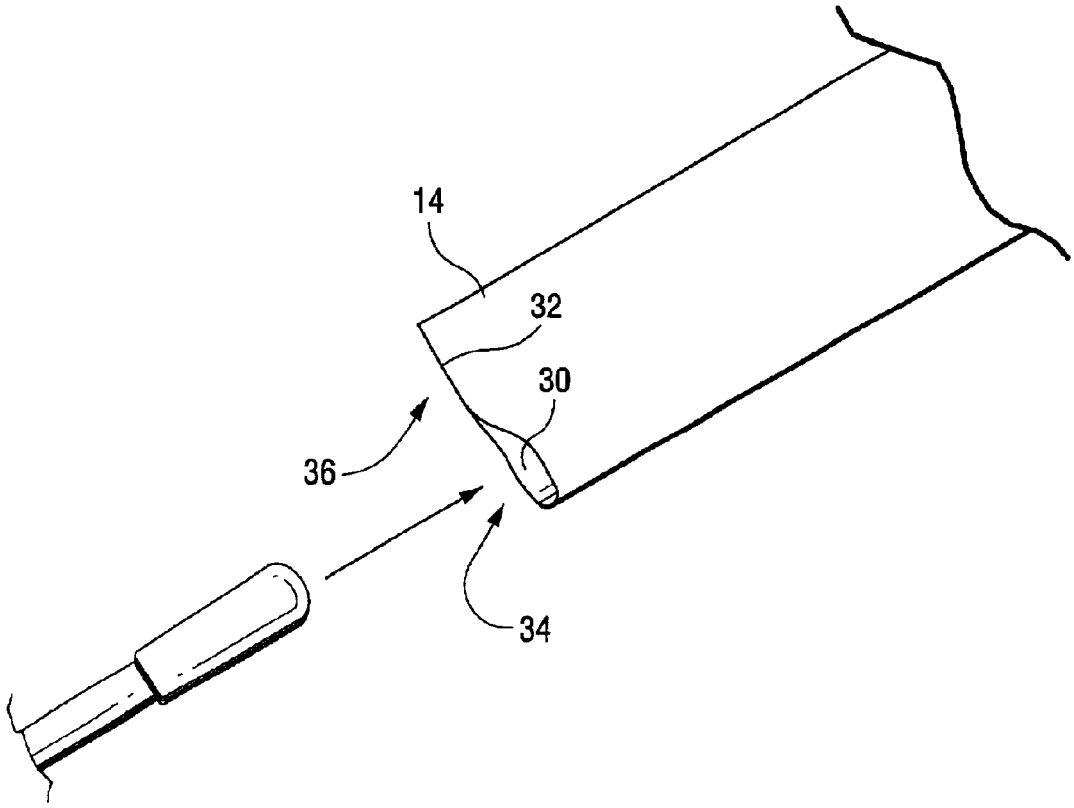
FIG. 1A is a close-up view of the boat cover sleeve end.

Before or after assembling each of the shock-corded poles 20, the cover member 12 is installed on the boat in a usual manner. As shown in FIG. 1A, at least one end possibly both of each of the sleeves 14 includes an open portion 30 and a closed portion 32 defining an entry channel 34 of about 1" and a holding area 36 of about 1½" for the flexible poles 20. As noted, preferably, the sleeves 14 are made of a reinforced fabric. Alternatively, an opposite end of the sleeves 14, shown at the bow end 18 in FIG. 1, may be provided with a reinforced end panel 38. With the former arrangement, the ends of the poles 20 are prevented from getting caught on the transition of the materials, which creates some difficulty removing the poles 20 from the sleeves 14. Moreover, the flexible poles 20 can be inserted into the sleeves 14 through either end. After installing the cover member 12, the poles 20 are inserted into respective sleeves 14 via the entry channel 34 in the sleeves 14. Once the shock-corded pole 20 is fully inserted into the sleeve 14 into engagement with the holding area 36 or reinforced end panels 38 at the opposite end of the sleeves 14, the trailing end of the pole 20 is shifted in the sleeve 14 into engagement with the holding area 36 via the closed portion 32 of the sleeve 14. In this manner, the shock-corded pole 20 is secured in place.

The poles 20 are generally configured in a length slightly shorter than a length of the sleeves 14. In this manner, when the poles 20 are trapped at the stern end 16 and the bow end 18, the poles 20 form an arc over the boat windshield, creating a "tenting" effect that supports the cover and aids in the run-off of rainwater. That is, the dome/convex shape that the cover 10 takes when installed on a boat is created in effect by securing the cover around the perimeter of the boat. If the cover member 12 were layed out flat on the floor and the poles 20 inserted into the sleeves 14, the cover member 12 would still lay flat. With that cover positioned over a boat, tied down securely in the bow, the convex shape is created by bending the cover member 12 and poles 20 over the windshield and then securing the cover member in the stern. Similar to conventional covers, the design incorporates a ¼" diameter nylon rope, sewn into the hem of the cover member 12, completely around the perimeter of the cover member 12. The rope ends protrude from an opening in the hem. Once the cover member 12 is positioned over the boat, the rope is drawn tight around the hull securing the cover member 12 to the boat—usually just under the rubrail of the boat. It is this process of securing the cover in place that actually creates the shape that causes water to run off instead of pocketing in the bow and stern areas as it normally would.

With the self-supporting boat cover of the present invention, an effective boat cover is provided that is inexpensive to manufacture is easily installed. Additionally, the supporting poles that create the "tenting" effect can be readily disassembled into a compact and easily transportable configuration.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A self-supporting boat cover comprising:

a cover member including a plurality of sleeves that extend substantially longitudinally from a bow end of the cover member to a stern end; and a corresponding plurality of flexible poles insertable in the sleeves through either end of the sleeves, ends of the flexible poles being releasably securable within the sleeves to fix the cover member relative to the poles.

2. A self-supporting boat cover comprising:

a cover member including a plurality of sleeves that extend substantially longitudinally from a bow end of the cover member to a stern end, wherein the sleeves converge from one of the bow end and the stern end toward the other of the bow end and the stern end; and a corresponding plurality of flexible poles insertable in the sleeves through either end of the sleeves, ends of the flexible poles being releasably securable within the sleeves.

3. A self-supporting boat cover according to claim 2, wherein the sleeves converge from the stern end toward the bow end.

4. A self-supporting boat cover comprising:

a cover member including a plurality of sleeves that extend substantially longitudinally from a bow end of the cover member to a stern end; and a corresponding plurality of flexible poles insertable in the sleeves through either end of the sleeves, the flexible poles being releasably securable in the sleeves, wherein each end of the sleeves comprises an open portion and a closed portion defining an entry channel and a holding area for the flexible poles, respectively.

5. A self-supporting boat cover comprising:

a cover member including a plurality of sleeves that extend substantially longitudinally from a bow end of the cover member to a stern end; and a corresponding plurality of flexible poles insertable in the sleeves through either end of the sleeves, the flexible poles being releasably securable in the sleeves, wherein the sleeves extend along at least 70% of the cover member, and wherein the flexible poles are configured in a length slightly shorter than a length of the sleeves.

6. A self-supporting boat cover according to claim 1, wherein the sleeves extend along at least 80% of the cover member, and wherein the flexible poles are configured in a length slightly shorter than a length of the sleeves.

7. A self-supporting boat cover according to claim 1, wherein each of the flexible poles comprises a plurality of pole sections releasably secured to one another, the number of pole sections being dependent on a length of the cover member.

8. A self-supporting boat cover according to claim 7, wherein each of the pole sections comprises a first end containing an insert tube disposed partially in and partially out of the pole section and a second end sized to receive the insert tube of an adjacent pole section.

9. A self-supporting boat cover according to claim 8, wherein an elastic cord is internally secured between each of adjacent pole sections, the elastic cord biasing the adjacent pole sections toward engagement with each other.

10. A self-supporting boat cover according to claim 7, wherein each of the flexible poles comprises at least five pole sections.

11. A self-supporting boat cover according to claim 7, wherein each of the flexible poles comprises ten pole sections.

12. A method of securing a self-supporting boat cover to a boat, the boat cover including a cover member having a plurality of sleeves that extend substantially longitudinally from a bow end of the cover member to a stern end, and a corresponding plurality of flexible poles insertable in the sleeves through either end of the sleeves, the method comprising:

(a) attaching the cover member to the boat; and (b) releasably securing the flexible poles into respective ones of the sleeves.

13. A method according to claim 12, wherein each end of the sleeves comprises an open portion and a closed portion defining an entry channel and a holding area for the flexible poles, respectively, and wherein step (b) is practiced by inserting the flexible poles through the entry channel then securing the flexible poles in the holding area.

14. A method according to claim 12, further comprising, prior to step (b), the step of assembling the flexible poles by releasably securing a plurality of pole sections to one another, the number of pole sections being dependent on a length of the cover member.

15. A self-supporting boat cover comprising:

a cover member including a plurality of sleeves that extend longitudinally and diverge from a bow end of the cover member to a stern end; and a corresponding plurality of flexible poles insertable in the sleeves through either end of the sleeves, the flexible poles being releasably securable in the sleeves.

16. A self-supporting boat cover according to claim 15, wherein each end of the sleeves comprises an open portion and a closed portion defining an entry channel and a holding area for the flexible poles, respectively.

17. A self-supporting boat cover according to claim 15, wherein the sleeves extend along at least 70% of the cover member, and wherein the flexible poles are configured in a length slightly shorter than a length of the sleeves.

18. A self-supporting boat cover according to claim 15, wherein the sleeves extend along at least 80% of the cover member, and wherein the flexible poles are configured in a length slightly shorter than a length of the sleeves.

19. A self-supporting boat cover according to claim 15, wherein each of the flexible poles comprises a plurality of pole sections releasably secured to one another, the number of pole sections being dependent on a length of the cover member.

* * * * *